United States Patent [19]

Remberg et al.

[11] 4,170,364

[45] Oct. 9, 1979

[54] SHAFT SEALING SYSTEM FOR A STEAM TURBINE

[75] Inventors: Axel Remberg; Willi Triesch, both of Mülheim, Fed. Rep. of Germany

[73] Assignee: Kraftwerk Union Aktiengesellschaft, Mülheim, Fed. Rep. of Germany

[21] Appl. No.: 822,796

[22] Filed: Aug. 8, 1977

[30] Foreign Application Priority Data

Aug. 10, 1976 [DE] Fed. Rep. of Germany ..... 2635918

[51] Int. Cl.[2] ..... F01D 25/24; F16J 15/26; F16J 15/44

[52] U.S. Cl. ..... 277/53; 277/59; 277/192; 277/226; 415/219 R

[58] Field of Search ..... 277/53, 59, 192, 199; 415/219 R

[56] References Cited

U.S. PATENT DOCUMENTS

| | | | |
|---|---|---|---|
| 978,399 | 12/1910 | Rotter | 277/53 X |
| 2,558,183 | 6/1951 | Kosatka | 277/192 X |
| 3,412,928 | 11/1968 | Hull et al. | 415/219 R |
| 3,503,616 | 3/1970 | Hickey | 277/53 X |
| 3,741,680 | 6/1973 | Killmann et al. | 415/219 R |

FOREIGN PATENT DOCUMENTS

| | | | |
|---|---|---|---|
| 1817044 | 8/1969 | Fed. Rep. of Germany | 277/53 |
| 83644 | 6/1935 | Sweden | 277/53 |

*Primary Examiner*—Robert S. Ward, Jr.
*Attorney, Agent, or Firm*—Herbert L. Lerner

[57] ABSTRACT

Shaft sealing system for a steam turbine having a horizontally divided outer housing and a shaft sealing cover disposed at an end of the outer housing includes a shaft seal having a part thereof received in the cover, an outer and lower part of the shaft seal together with a respective part of the cover being rigid with the outer housing, and an upper cover segment, having a parting joint in common with the lower part of the shaft seal at the level of an upper edge of a flange for the horizontally divided outer housing, being threadedly securable to the outer housing.

5 Claims, 3 Drawing Figures

SHAFT SEALING SYSTEM FOR A STEAM TURBINE

The invention relates to a shaft sealing system for a steam turbine and, more particularly, to such a steam turbine having an horizontally divided outer housing and a shaft sealing cover disposed at an end of the outer housing, part of the shaft seal being received in the cover.

A shaft sealing system of the foregoing general type has become known from German Published Non-Prosecuted Application DT-OS No. 1 817 044 wherein there is disclosed that the shaft sealing cover threadedly secured over the entire periphery thereof as well as the housing are horizontally divided, and the upper and lower parts of the cover are threadedly secured to one another through corresponding flanges. This separated construction of the cover is required in order to be able to control part of the shaft seals and the sealing points or tips thereof and, when necessary, without having to open the entire turbine section, to insert sealing bands so as to stem or prevent thereby the outflow of steam until the next main inspection. A disadvantage of such a separated cover is, however, that because of the annular flange thereof, the parting-joint screws for the turbine housing at this location must be shifted relatively far outwardly so that difficulties arise in the sealing of the parting joints of the outer housing.

It is accordingly an object of the invention to provide a shaft sealing system and, especially, a shaft sealing cover, which is of such construction as to afford an improved sealing of the parting joints of the outer housing in vicinity of the shaft seal as compared to heretofore known shaft sealing systems or covers of this general type.

With the foregoing and other objects in view, there is provided in accordance with the invention, a shaft sealing system for a steam turbine having a horizontally divided outer housing and a shaft sealing cover disposed at an end of the outer housing comprising a shaft seal having a part thereof received in the cover, an outer and lower part of the shaft seal together with a respective part of the cover being rigid with the outer housing, and an upper cover segment having a parting joint in common with the lower part of the shaft seal at the level of an upper edge of a flange for the horizontally divided outer housing, being threadedly securable to the outer housing.

In accordance with another feature of the invention, the outer and lower part of the shaft seal together with the respective part of the cover rigid with the outer housing are formed as a one-piece casting therewith.

In accordance with a further feature of the invention, the upper cover segment is formed with a flange disposed substantially horizontally within the peripheral contour of the upper cover segment, the upper cover segment being threadedly secured through the flange thereof to the lower part of the cover.

In accordance with an added feature of the invention, flange screws of the outer turbine housing are disposed in vicinity of the shaft seal adjacent the flange of the upper cover segment.

In accordance with a concomitant feature of the invention, suction connecting pipes are secured to the upper cover segment and communicate with an inner space formed in the shaft seal for applying suction thereto.

Due to the fact that the lower part of the cover is molded to or cast with the housing and only an upper segment is constructed so as to be loosenable or detachable, the screws of the parting joint for the outer housing can be shifted farther inwardly at this location so that a better sealing of the parting joint in this region is attained thereby.

Although the invention is illustrated and described herein as embodied in shaft sealing system for a steam turbine, it is nevertheless not intended to be limited to the details shown, since various modifications and structural changes may be made therein without departing from the spirit of the invention and within the scope and range of equivalents of the claims.

The construction and method of the invention, however, together with additional objects and advantages thereof, will be best understood from the following description of specific embodiments when read in connection with the accompanying drawings, in which.

Figure 3:
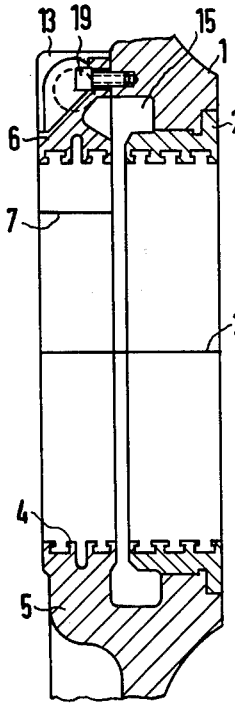
FIG. 3 is a longitudinal sectional view of FIG. 1 taken along the line III—III in the direction of the arrows.
Figure 1:
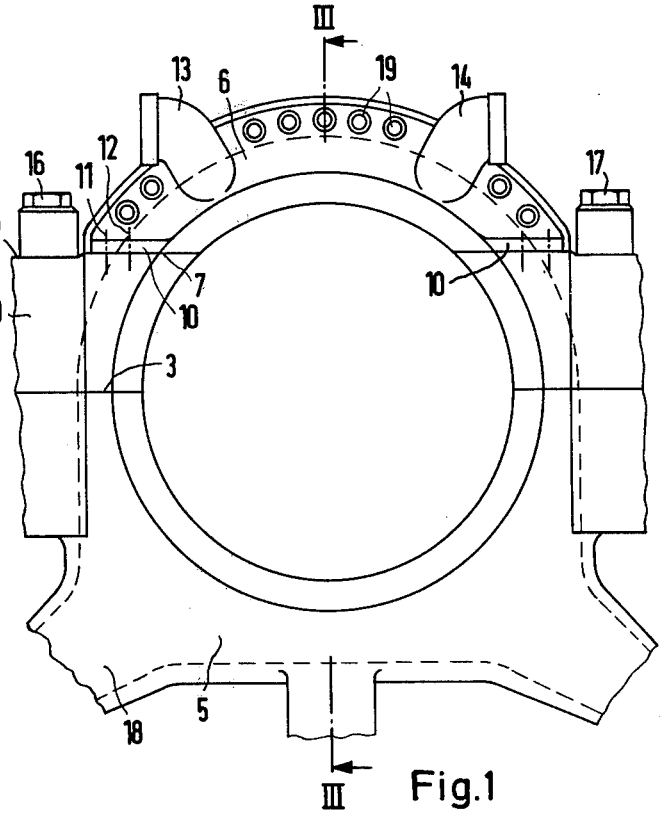
FIG. 1 is an end view of a shaft seal cover incorporating the sealing system according to the invention.
Figure 2:
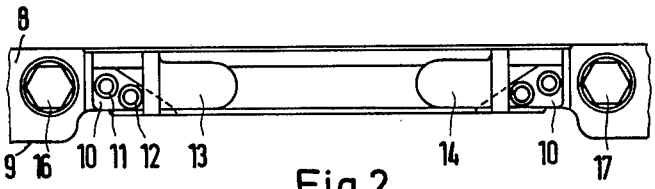
FIG. 2 is a top plan view of FIG. 1.

Referring now to FIG. 1 of the drawing and also specifically to FIG. 3 thereof, there is shown seated in the end wall of a turbine housing 1, a shaft sealing housing 2 for receiving therein non-illustrated ring segments for a labyrinth seal. The turbine housing 1 and the shaft seal housing 2 are horizontally divided at partial joints 3. The cover sealing part 4 with the cover part 5 associated therewith is molded to or cast with the turbine housing 1 and forms a part of the cover which is seated on the end wall of the housing and receives the shaft seal therein, in accordance with the invention. Only an upper cover segment 6 of the cover is constructed so as to be threadedly securable, the partial joint 7 to the lower part 5 extending at the level of the upper edge 8 of the outer housing flange 9. The cover segment 6 is threadedly secured by means of axial screws 8 to the turbine housing 1 and has, at the horizontal partial joint 7 thereof, a corresponding flange 10 above which the cover segment 6 is threadedly secured by means of screws 11 and 12 to the lower part 5 of the cover. The cover segment 6 additionally has conventional connecting pipes or unions 13 and 14 through which suction may be applied to an annular space 15 between the shaft sealing sections found, on the one hand, by the cover segment 6 and the cover sealing part 4 and, on the other hand, by the shaft sealing housing 2 and the turbine housing 1, as shown in FIG. 3.

Due to the fact that only an upper segment of the cover is detachably or releasably constructed and this releasable section extends above the housing flange, the heretofore required cover ring flange is dispensed with over a large part of the periphery and especially in vicinity of the flange 9, so that the partial joint screws 16 and 17 in vicinity of the shaft seal can be shifted farther inwardly whereby an improved sealing of the housing partial joint 9 is assured. The accessibility of the outer shaft sealing section 4 is fully assured, however, through the removability of the cover segment 6 as before. Due to the integrated construction of the lower part 5 of the cover, greater suction cross sections 18 in the lower part 4 of the shaft seal is moreover possible.

There are claimed:

1. Shaft sealing system for a steam turbine having a horizontally divided outer housing and a shaft sealing cover disposed at an end of the outer housing comprising a shaft seal having a part thereof received in the cover, an outer and lower part of said shaft seal together with a respective part of the cover being rigid with the outer housing, and an upper cover segment, having a parting joint in common with said lower part of said shaft seal at the level of an upper edge of a flange for the horizontally divided outer housing, being threadedly securable to the outer housing.

2. Shaft sealing system according to claim 1 wherein said outer and lower part of said shaft seal together with the respective part of the cover rigid with the outer housing, are formed as a one-piece casting therewith.

3. Shaft sealing system according to claim 1 wherein said upper cover segment is formed with a flange disposed substantially horizontally within the peripheral contour of said upper cover segment, said upper cover segment being threadedly secured through said flange thereof to said lower part of the cover.

4. Shaft sealing system according to claim 3 including flange screws of the outer turbine housing disposed in vicinity of said shaft seal adjacently the flange of said upper cover segment.

5. Shaft sealing system according to claim 1 including suction connecting pipes secured to said upper cover segment and communicating with an inner space formed in said shaft seal for applying suction thereto.

* * * * *